US007663559B2

(12) United States Patent
Hsieh et al.

(10) Patent No.: US 7,663,559 B2
(45) Date of Patent: Feb. 16, 2010

(54) ANTENNA STRUCTURE AND WIRELESS COMMUNICATION APPARATUS THEREOF

(75) Inventors: Chih-Sen Hsieh, Taipei Hsien (TW); Hung-Yi Lin, Taipei Hsien (TW); Feng-Chi Eddie Tsai, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 195 days.

(21) Appl. No.: 12/099,792

(22) Filed: Apr. 9, 2008

(65) Prior Publication Data

US 2009/0153414 A1 Jun. 18, 2009

(30) Foreign Application Priority Data

Dec. 14, 2007 (TW) ..... 96147813 A

(51) Int. Cl.
*H01Q 1/24* (2006.01)
*H01Q 1/48* (2006.01)

(52) U.S. Cl. ..... 343/702; 343/846

(58) Field of Classification Search ..... 343/700 MS, 343/702, 846, 848
See application file for complete search history.

(56) References Cited

U.S. PATENT DOCUMENTS 7,450,072 B2 * 11/2008 Kim et al. ..... 343/700 MS

* cited by examiner

*Primary Examiner*—Hoang V Nguyen
(74) *Attorney, Agent, or Firm*—Winston Hsu

(57) ABSTRACT

An antenna structure includes a radiation element, a grounding element, and a feeding point. The grounding element includes a first grounding sub-element and a second grounding sub-element. The second grounding sub-element is coupled to the first grounding sub-element and has a loop structure. One section of the loop structure overlaps a first end of the radiation element and is at a designated distance from the first end of the radiation element in a designated direction. The feeding point is coupled between a second end of the radiation element and the first grounding sub-element.

20 Claims, 14 Drawing Sheets

ANTENNA STRUCTURE AND WIRELESS COMMUNICATION APPARATUS THEREOF

BACKGROUND OF THE INVENTION

1. Field of the Invention

The present invention relates to an antenna structure and related wireless communication apparatus, and more particularly, to an antenna structure and related wireless communication apparatus for adjusting impedance matching and radiation patterns by using an overlapped portion overlapped by a loop structure of a grounding element and a radiation element at a designated distance from the radiation element.

2. Description of the Prior Art

As wireless telecommunication develops with the trend of micro-sized mobile communications products, the location and the space arranged for antennas becomes increasingly limited. Therefore, built-in micro antennas have been developed. Some micro antennas such as chip antennas and planar antennas are commonly used and occupy very small volume.

The planar antenna has the advantages of small size, light weight, ease of manufacturing, low cost, high reliability, and can also be attached to the surface of any object. Therefore, micro-strip antennas and printed antennas are widely used in wireless communication systems. For example, monopole antennas or dipole antennas are suited for use in 3G transceivers.

However, the conventional monopole antenna is a linear antenna, wherein its radiation pattern cannot be centered upwards and its half power beam-width is smaller than 120 degrees. The monopole antenna is unable to fill demands for 3G specifications such as global positioning system (GPS), under certain conditions. Therefore, how to reduce sizes of the antennas, improve antenna efficiency, improve radiation patterns, and increase bandwidths of the antennas become important topics in this field.

SUMMARY OF THE INVENTION

It is one of the objectives of the present invention to provide an antenna structure and related wireless communication apparatus to solve the abovementioned problems.

The present invention discloses an antenna structure. The antenna includes a radiation element, a grounding element, and a feeding point. The grounding element includes a first grounding sub-element and a second grounding sub-element. The second grounding sub-element is coupled to the first grounding sub-element and has a loop structure. One section of the loop structure overlaps a first end of the radiation element and is at a designated distance from the first end of the radiation element in a designated direction. The feeding point is coupled between a second end of the radiation element and the first grounding sub-element. The second grounding sub-element is located on a Y-Z plane, and a projection of the radiation element projected on an X-Y plane partially overlaps a projection of the second grounding sub-element projected on the X-Y plane.

In one embodiment, the second grounding sub-element includes a plurality of sections coupled to each other to construct the loop structure, and a joint point of a first section and a second section of the plurality of sections forms a right angle, an oblique angle, or an arc angle. In another embodiment, the loop structure includes a plurality of loops.

The present invention discloses a wireless communication apparatus. The wireless communication apparatus includes a housing and an antenna structure. The antenna structure is disposed inside the housing and parallel to a first plane of the housing. The antenna structure includes a radiation element, a grounding element, and a feeding point. The grounding element includes a first grounding sub-element and a second grounding sub-element. The second grounding sub-element is coupled to the first grounding sub-element and has a loop structure. One section of the loop structure overlaps a first end of the radiation element and is at a designated distance from the first end of the radiation element in a designated direction. The feeding point is coupled between a second end of the radiation element and the first grounding sub-element. The second grounding sub-element of the antenna structure and the first plane of the housing are located on a Y-Z plane, and a projection of the radiation element projected on an X-Y plane partially overlaps a projection of the second grounding sub-element projected on the X-Y plane.

In one embodiment, the wireless communication apparatus is a notebook computer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
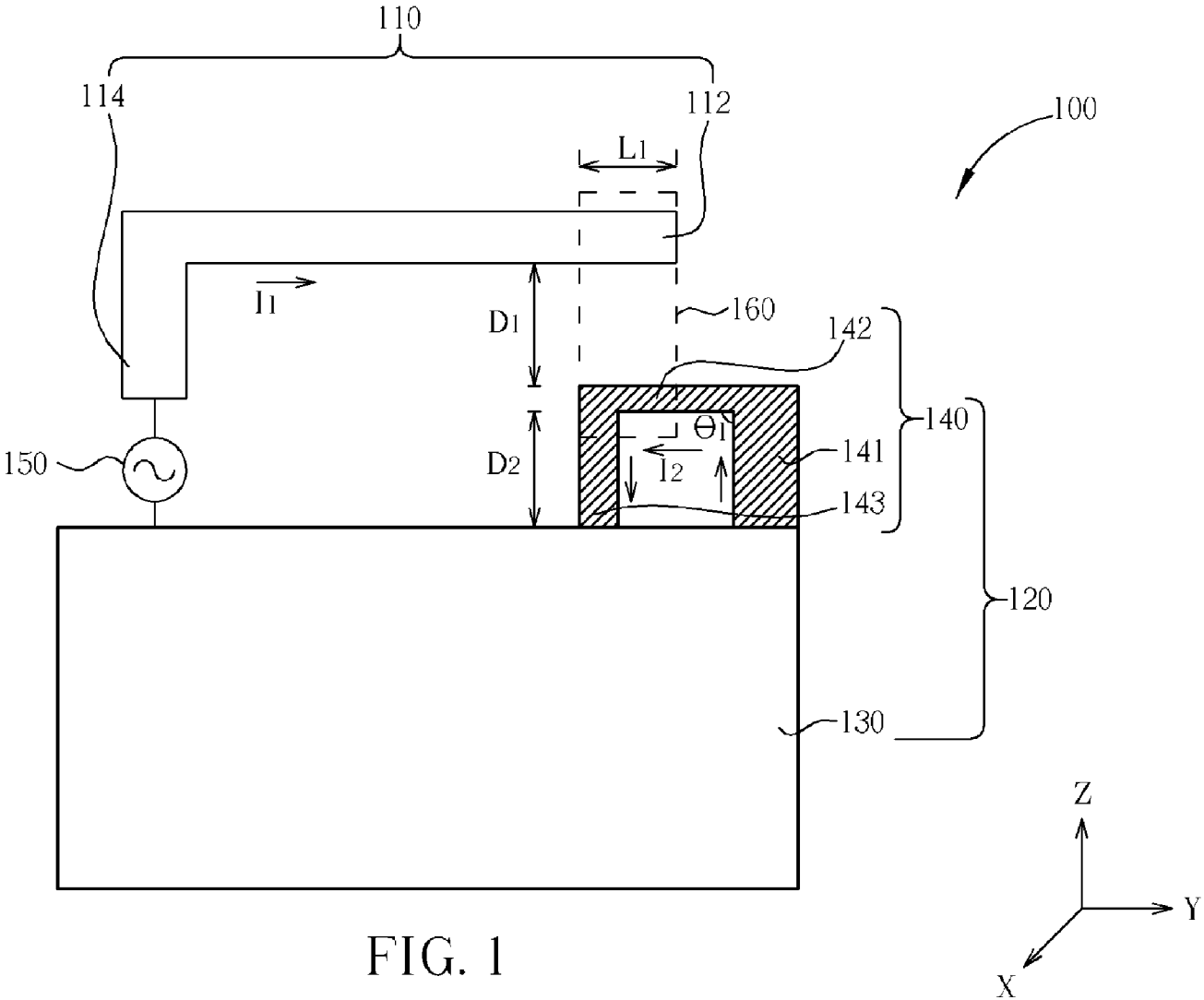
FIG. 1 is a diagram of an antenna structure according to a first embodiment of the present invention.

Please refer to FIG. 1. FIG. 1 is a diagram of an antenna structure 100 according to a first embodiment of the present invention. The antenna structure 100 includes a radiation element 110, a grounding element 120, and a feeding point 150. The radiation element 110 includes a first end 112 and a second end 114. The grounding element 120 includes a first grounding sub-element 130 and a second grounding sub-element 140. The feeding point 150 is coupled between the second end 114 of the radiation element 110 and the first grounding sub-element 130. The second grounding sub-element 140 is coupled to the first grounding sub-element 130.

The second grounding sub-element 140 has a plurality of sections 141, 142, and 143 coupled to each other to construct a loop structure, wherein the section 142 of the loop structure overlaps the first end 112 of the radiation element 110 and is at a designated distance $D_1$ from the first end 112 of the radiation element 110 in a designated direction (such as a direction of +Z axis in FIG. 1), and the section 142 is at a designated distance $D_2$ from the first grounding sub-element 130 in a direction opposite to the designated direction (such as a direction of −Z axis in FIG. 1). In other words, the section 142 of the loop structure and the first end 112 of the radiation element 110 have an overlapped portion 160 and there is the designated distance $D_1$ existing between them, wherein a length of the overlapped portion 160 is $L_1$. Please note that, the abovementioned overlapped portion 160 does not mean that the section 142 of the loop structure actually overlaps the first end 112 of the radiation element 110 and they contact each other, but means that visually they partially overlap each other on the designated direction (i.e., +Z axis). In this embodiment, the radiation element 110, the first grounding sub-element 130, and the second grounding sub-element 140 are all located on a Y-Z plane, and a projection of the radiation element 110 projected on an X-Y plane partially overlaps a projection of the second grounding sub-element 140 projected on the X-Y plane.

Please keep referring to FIG. 1. The first grounding sub-element 130 is a grounding plane with a large area, thus a direction of its current is not fixed. The sections 141, 142, and 143 of the second grounding sub-element 140 are each slender rectangles and a current $I_2$ flows through the sections 141, 142, and 143 in the direction of the arrow shown in FIG. 1. Similarly, the radiation element 110 has an L shape, wherein the first end 112 and the second end 114 are each slender rectangles and a current $I_1$ flows through the first end 112 in the direction of the arrow shown in FIG. 1. In the embodiment, through adding the sections 141, 142, and 143 of the second grounding sub-element 140 into the antenna structure 100, the direction of the current $I_2$ can be adjusted. In addition, the impedance matching and radiation patterns of the antenna structure can be further changed by a capacitor effect generated from the overlapped portion 160. Through adjusting parameters such as the length $L_1$, and the designated distances $D_1$ and $D_2$, a goal of adjusting the energy of the antenna structure upwards can be achieved (i.e., the +Z axis). Moreover, through changing widths of the sections 141, 142, and 143 of the second grounding sub-element 140, the impedance matching of the antenna structure 100 can be tuned.

Please note that, as mentioned above, the radiation element 100 has an L shape and the first end 112 and the second end 114 are each a slender rectangle, but this is not a limitation of the present invention. Those skilled in the art should appreciate that various modifications of the radiation element 110 may be made.

Please also note that, a joint point of the first section 141 and the second section 142 of the second grounding sub-element 140 forms a right angle (i.e., $\theta_1$=90°) in this embodiment. Of course, the antenna structure 100 shown in FIG. 1 is merely an embodiment of the present invention, and, as is well known by persons of ordinary skill in the art, suitable variations can be applied to the antenna structure 100. In the following, several embodiments illustrate various modifications of the antenna structure 100.

Figure 2:
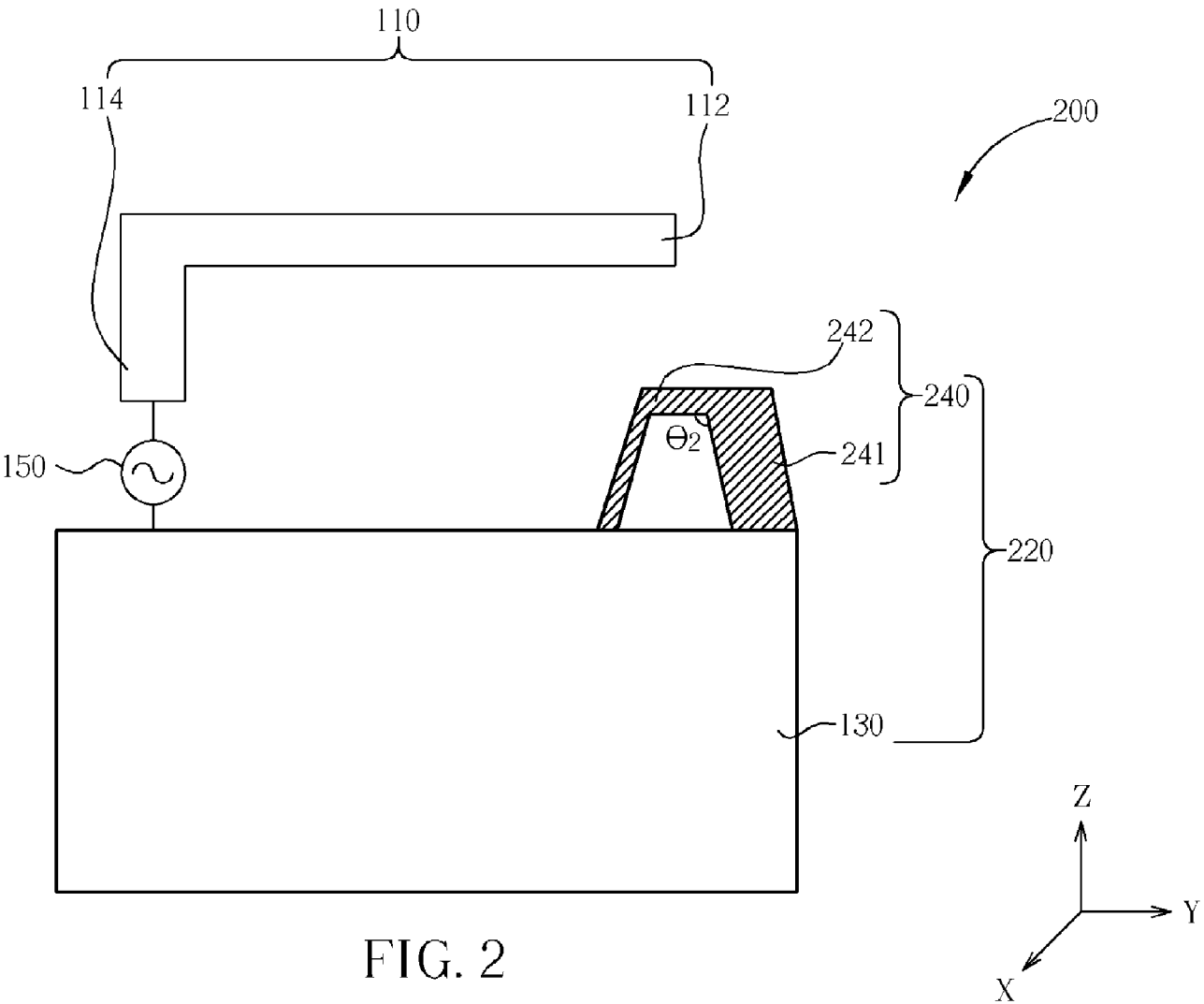
FIG. 2 is a diagram of an antenna structure according to a second embodiment of the present invention.

Please refer to FIG. 2. FIG. 2 is a diagram of an antenna structure 200 according to a second embodiment of the present invention, which is a varied embodiment of the antenna structure 100 shown in FIG. 1. In FIG. 2, the architecture of the antenna structure 200 is similar to that in FIG. 1, and the difference between them is that a joint point of a first section 241 and a second section 242 of a second grounding sub-element 240 included by a grounding element 220 of the antenna structure 200 forms an oblique angle; that is, the angle $\theta_2$ is not 90° (in this embodiment, $\theta_2$>90°).

Figure 3:
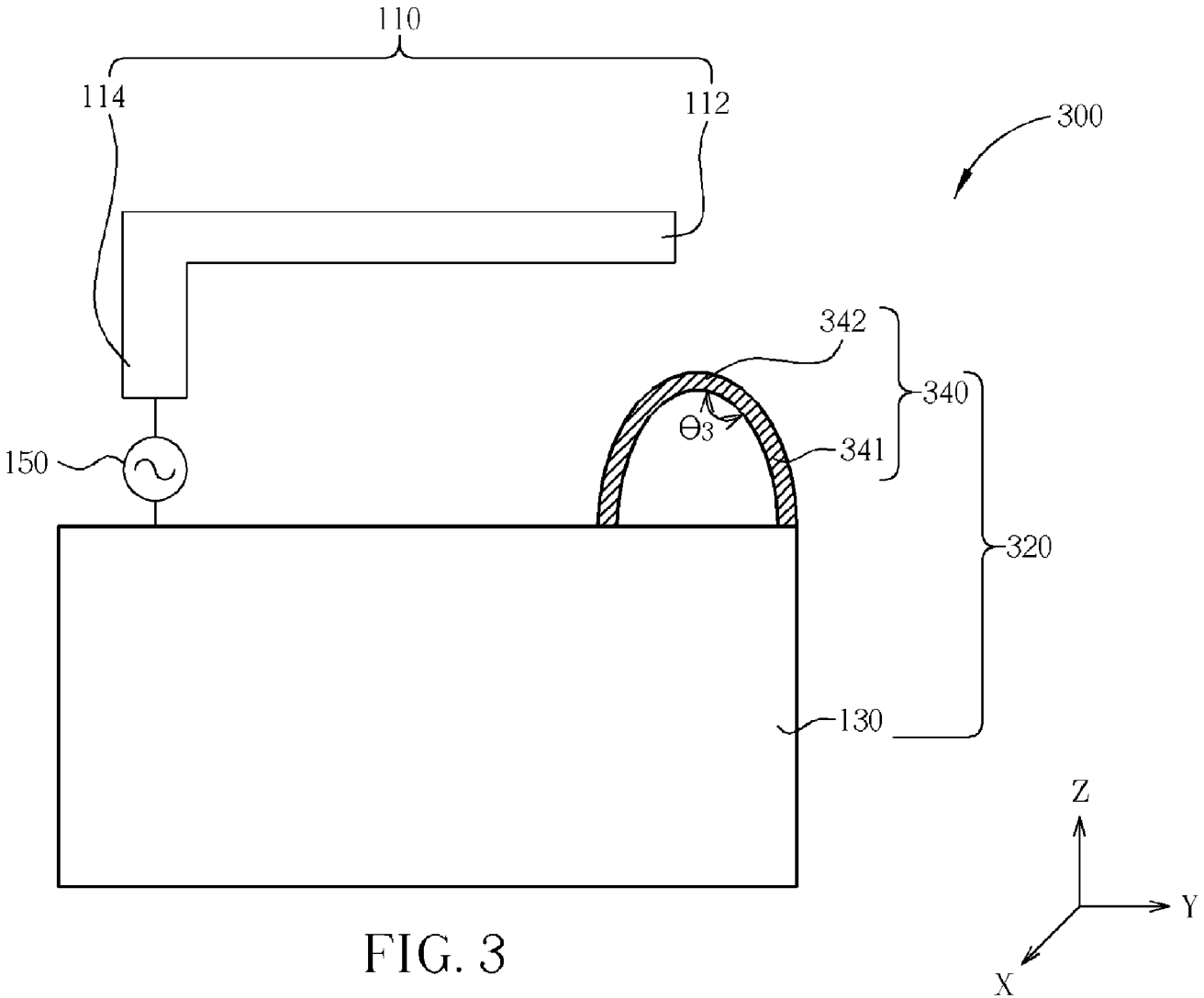
FIG. 3 is a diagram of an antenna structure according to a third embodiment of the present invention.

Please refer to FIG. 3. FIG. 3 is a diagram of an antenna structure 300 according to a third embodiment of the present invention, which is a varied embodiment of the antenna structure 100 shown in FIG. 1. In FIG. 3, the architecture of the antenna structure 300 is similar to that in FIG. 1, and the difference between them is that a joint point of a first section 341 and a second section 342 of a second grounding sub-element 340 included by a grounding element 320 of the antenna structure 300 forms an arc. In other words, the angle $\theta_3$ is an arc angle.

Figure 4:
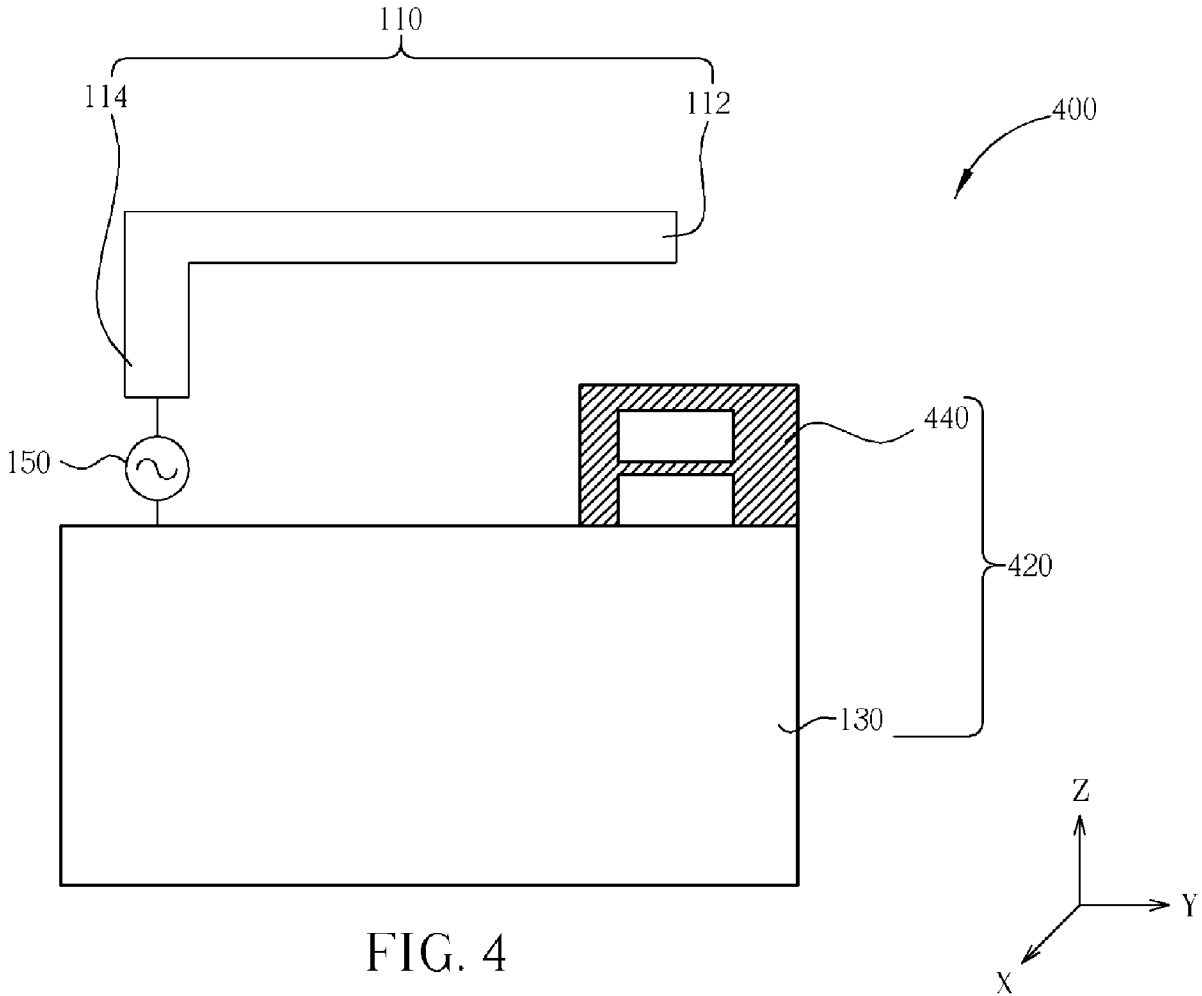
FIG. 4 is a diagram of an antenna structure according to a fourth embodiment of the present invention.
Figure 5:
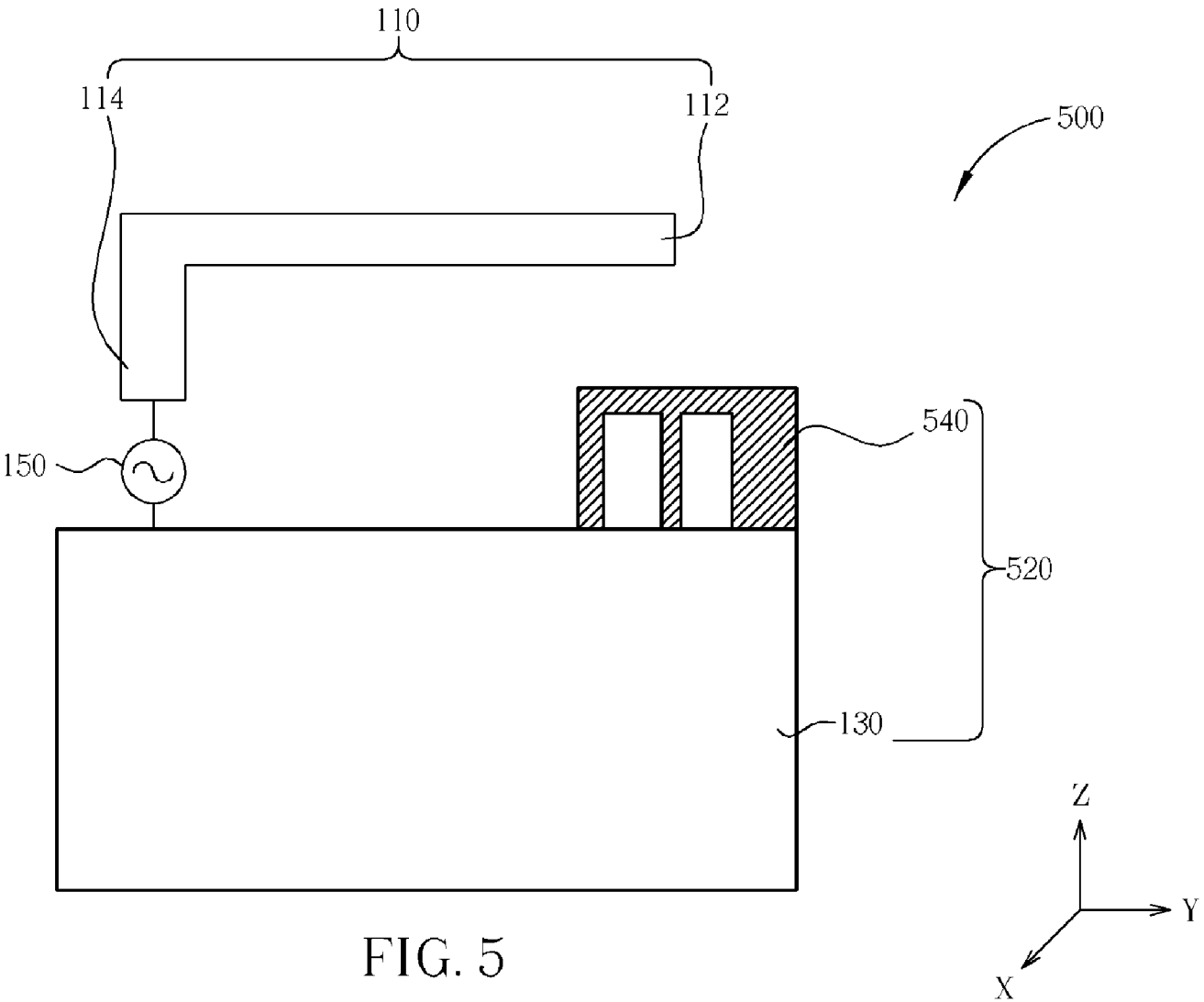
FIG. 5 is a diagram of an antenna structure according to a fifth embodiment of the present invention.
Figure 6:
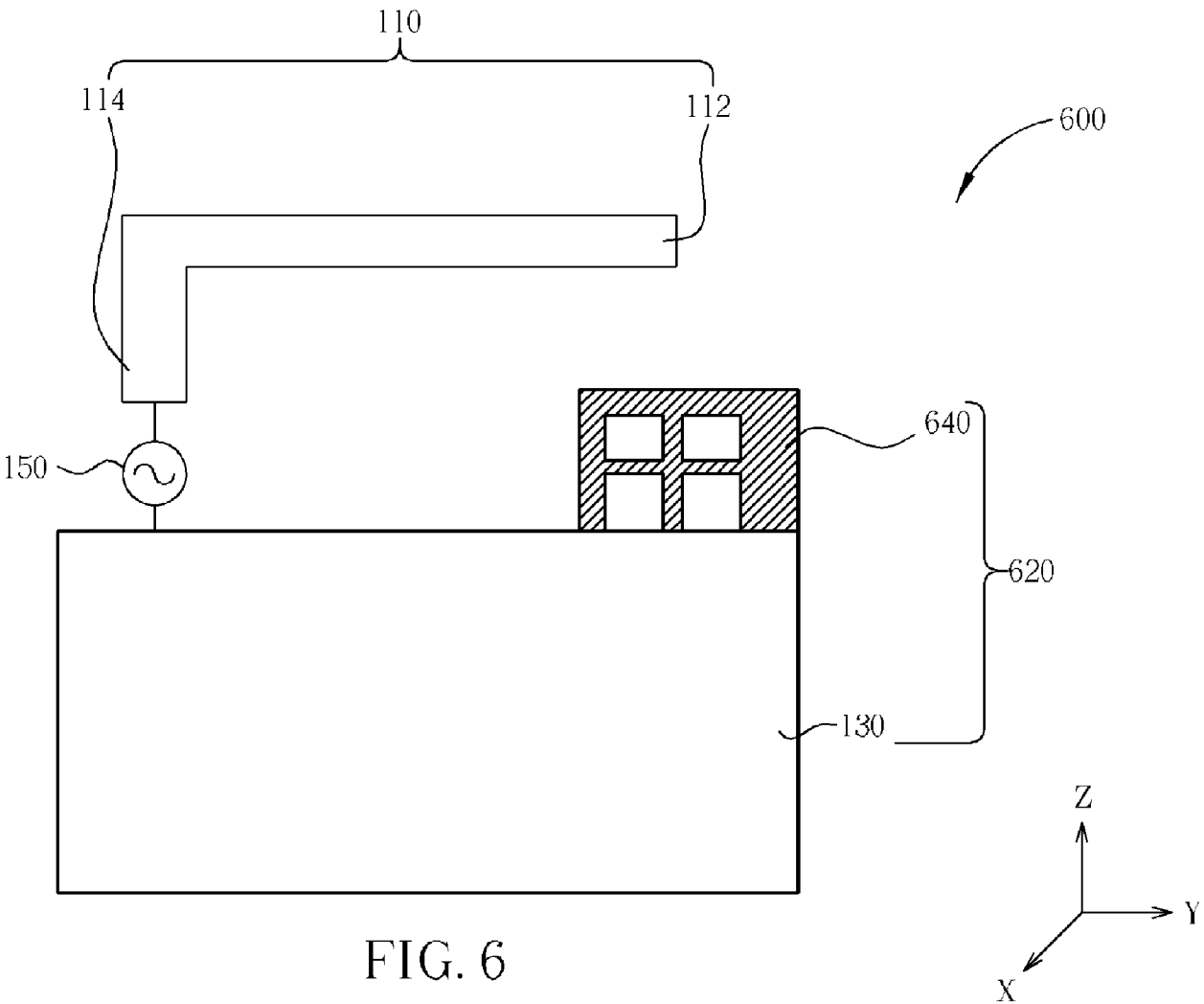
FIG. 6 is a diagram of an antenna structure according to a sixth embodiment of the present invention.

Please refer to FIG. 4-FIG. 6. FIG. 4, FIG. 5, and FIG. 6 are respectively a diagram of an antenna structure according to a fourth, fifth, and sixth embodiment of the present invention. In FIG. 4-FIG. 6, the difference between antenna structures 400, 500, and 600 and the antenna structure 100 in FIG. 1 is that each of the loop structure of second grounding sub-elements 440, 540, and 640 respectively includes a plurality of loops, wherein their numbers, shapes, and sizes are different from each other. Those skilled in the art should appreciate that this is not a limitation of the present invention and various modifications of the number of loops, the shape, and the size of the loop structure may be made.

Figure 7:
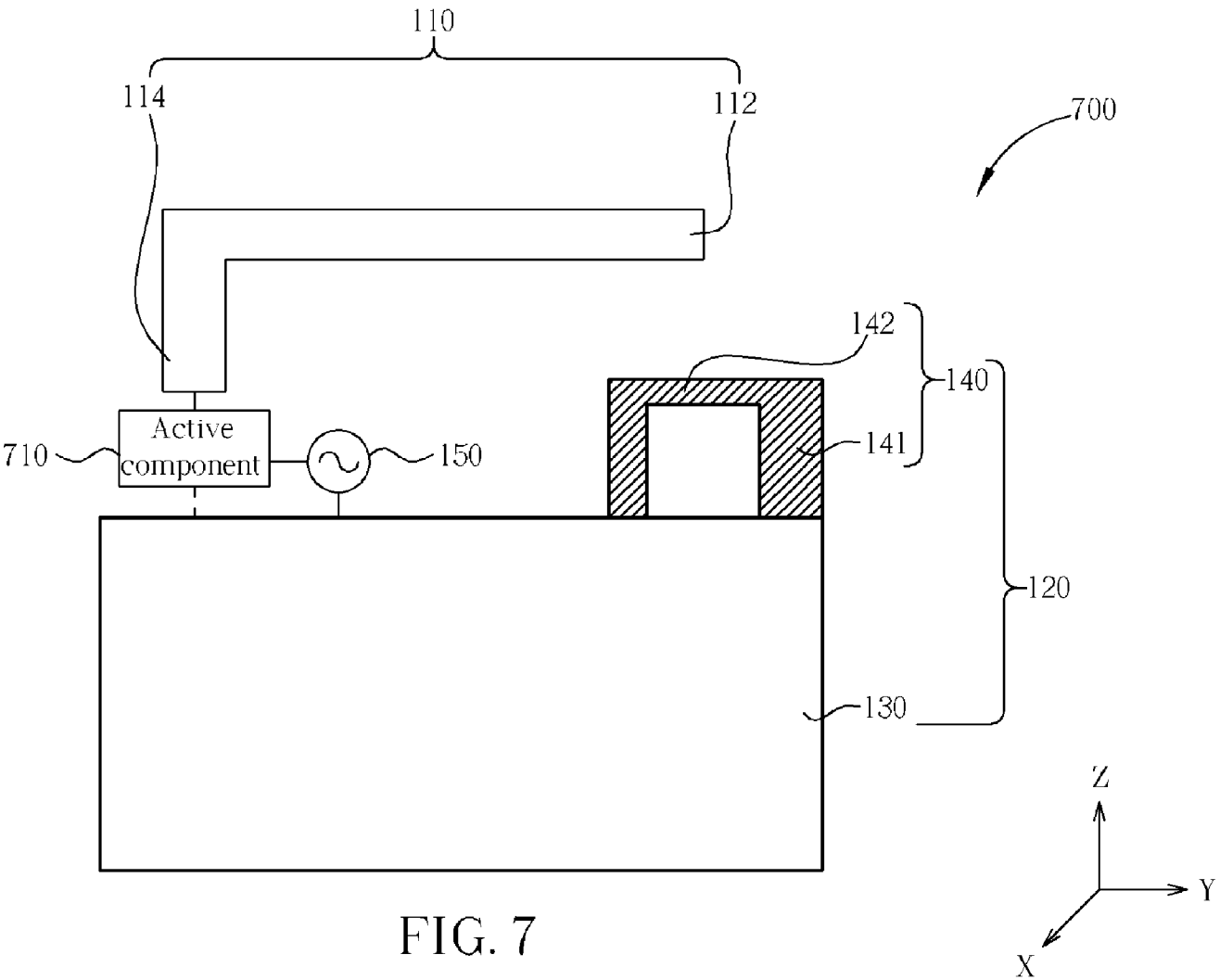
FIG. 7 is a diagram of an antenna structure according to a seventh embodiment of the present invention.

Please refer to FIG. 7. FIG. 7 is a diagram of an antenna structure 700 according to a seventh embodiment of the present invention. In FIG. 7, the architecture of the antenna structure 700 is similar to that of the antenna structure 100, but the antenna structure 700 further includes an active component 710 disposed between the second end 114 of the radiation element 110 and the feeding point 150. In one embodiment, the active component 710 can be a low-noise amplifier (LNA) or a matching circuit, but is not meant as a limitation of the present invention. Those skilled in the art should appreciate that active components of other types can also be disposed between the second end 114 of the radiation element 110 and the feeding point 150 without departing from the spirit of the present invention, which should also belong to the scope of the present invention.

Those skilled in the art should appreciate that various modifications of the antenna structures in FIG. 1-FIG. 7 may be made without departing from the spirit of the present invention. For example, the antenna structures in FIG. 1-FIG. 7 can be arranged or combined randomly into a new varied embodiment. The abovementioned embodiments are presented merely for illustrating practicable designs of the present invention, and should not be limitations of the present invention. Furthermore, the number of loops, the shape, and the size of the loop structure are not limited.

In addition, a comparison of the antenna structure disclosed in the present invention with a conventional monopole antenna to further expand advantages of the antenna structure disclosed in the present invention will now be provided.

Figure 8:
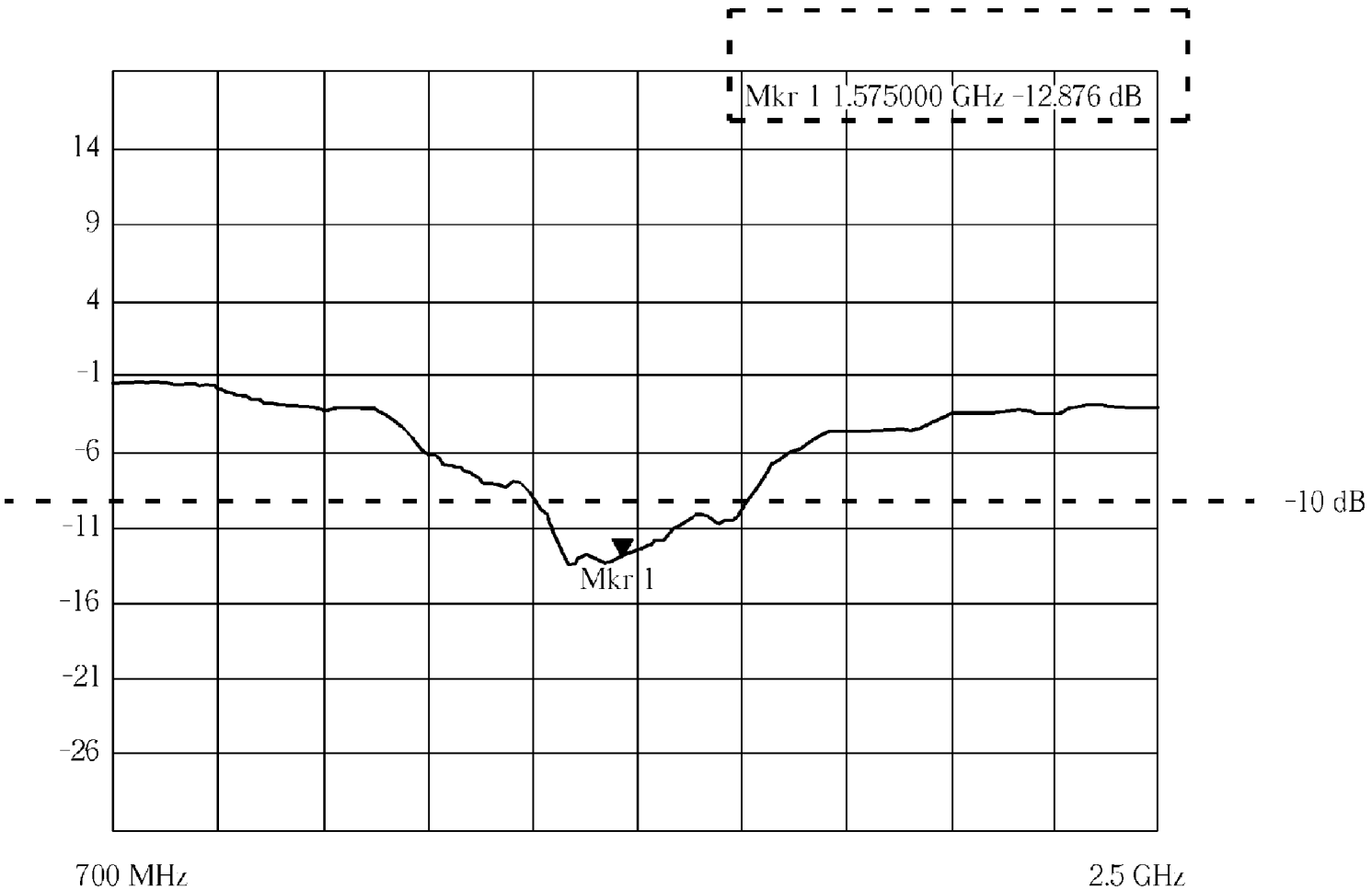
FIG. 8 is a diagram illustrating the return loss of the conventional monopole antenna.
Figure 9:
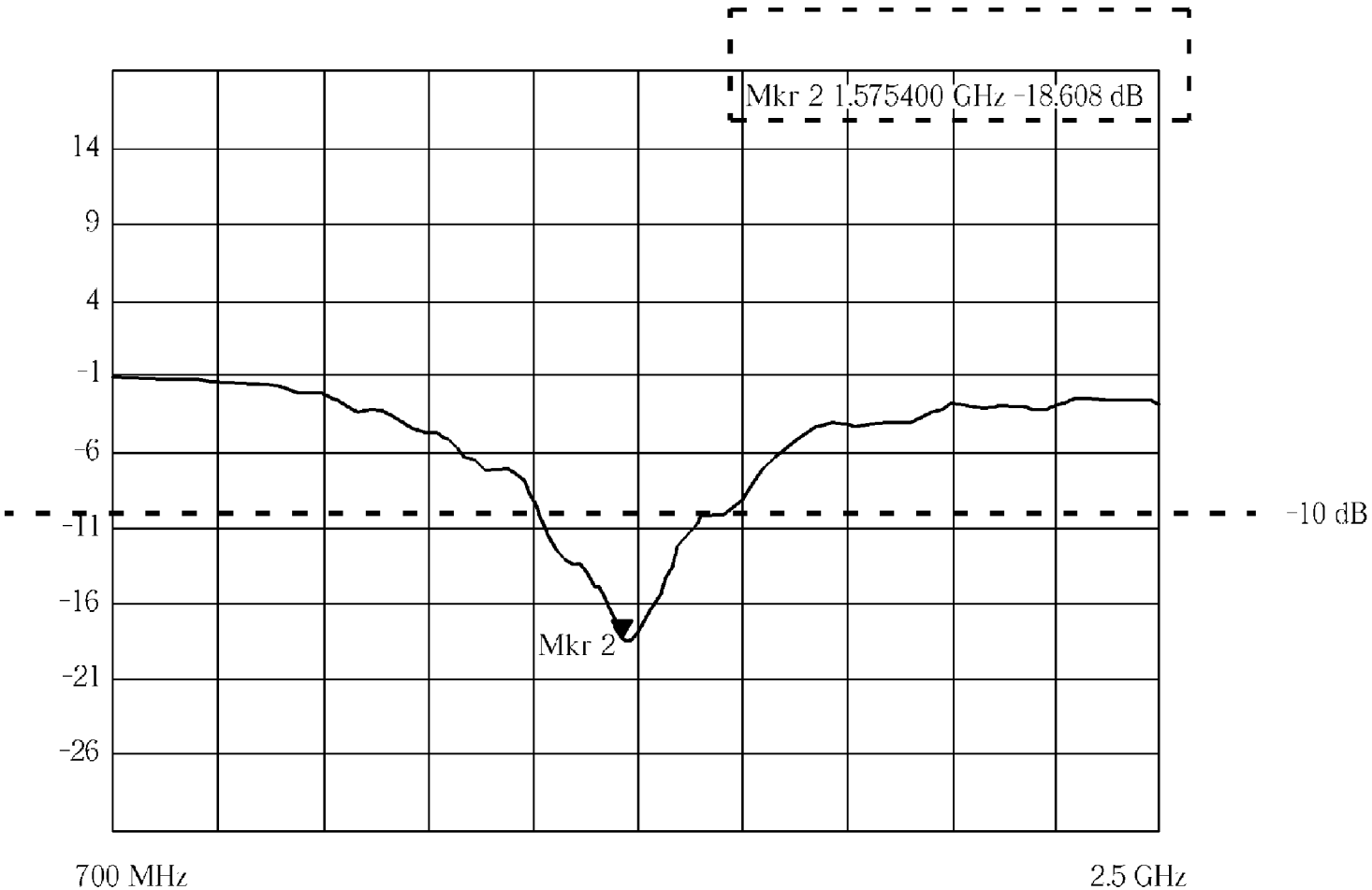
FIG. 9 is a diagram illustrating the return loss of the antenna structure shown in FIG. 1.

Please refer to FIG. 8 together with FIG. 9. FIG. 8 is a diagram illustrating the return loss of the conventional monopole antenna, and FIG. 9 is a diagram illustrating the return loss of the antenna structure 100 shown in FIG. 1. The conventional monopole antenna mentioned herein means an antenna having a single radiation object and a grounding plane with a large area: for example, a combination formed by the radiation element 110, the first grounding sub-element 130, and the feeding point 150 without containing each part of the second grounding sub-elements 140. As shown in FIG. 8, the frequency 1.575 GHz and the return loss (−12.876 dB) of a sign Mkr_1 are marked. As shown in FIG. 9, the frequency 1.575 GHz and the return loss (−18.608 dB) of a sign Mkr_2 are marked. As is known by comparing them, the return loss of the antenna structure 100 in FIG. 1 is much deeper than that of the conventional monopole antenna (i.e., −18.608 dB<−12.876 dB). Those skilled in the art should appreciate that the return loss can be transformed into the voltage standing wave ratio (VSWR) through equations, thus the return loss and the VSWR essentially have the same meaning. In other words, the VSWR of the antenna structure 100 in FIG. 1 is much better than that of the conventional monopole antenna, and the antenna structure 100 can satisfy demands of the wireless communication system (for example, the GPS application).

In this embodiment, the radiation element 110 resonates at an operating frequency band of a 3G wireless communication system—for example, at the operating frequency band 1570 MHz-1580 MHz of GPS—but this is not a limitation of the present invention and can be applied to wireless communication systems of other types. The length of the radiation element 110 is approximately one-fourth of a wavelength ($\lambda/4$) of a resonance mode generated by the antenna structure 100.

Figure 10:
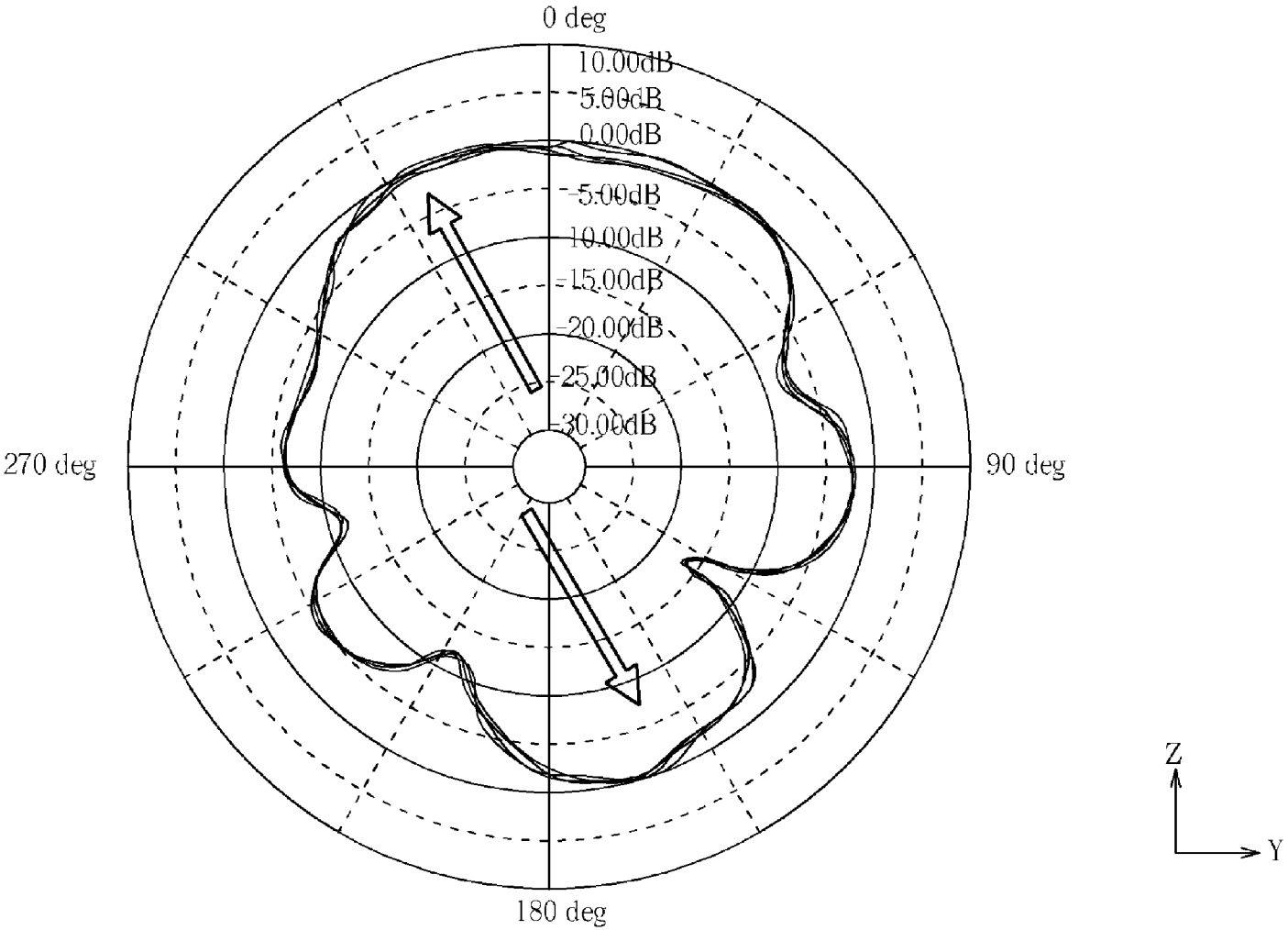
FIG. 10 is a diagram illustrating a radiation pattern of the conventional monopole antenna.
Figure 11:
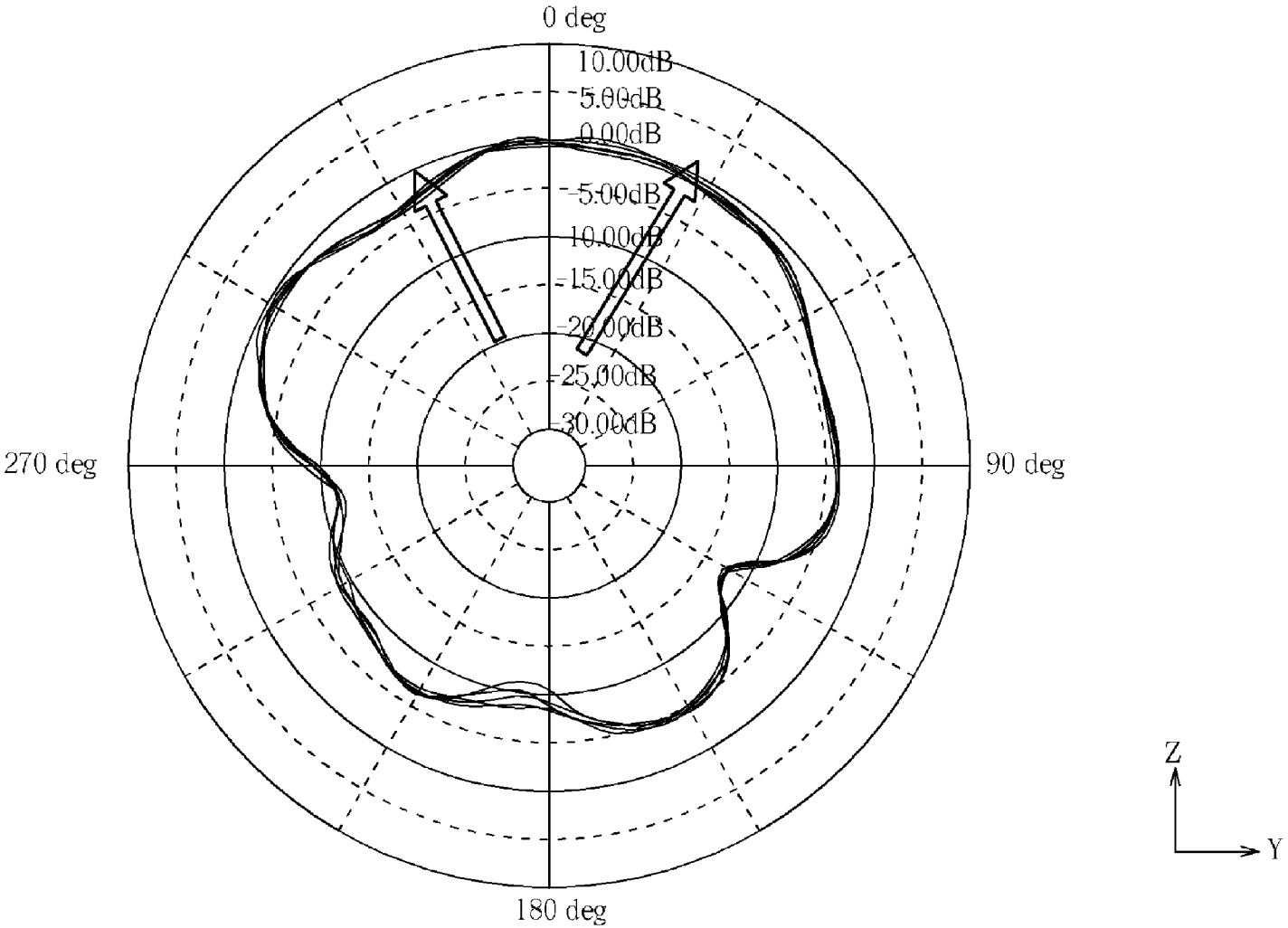
FIG. 11 is a diagram illustrating a radiation pattern of the antenna structure shown in FIG. 1.

Please refer to FIG. 10 together with FIG. 11. FIG. 10 is a diagram illustrating a radiation pattern of the conventional monopole antenna, and FIG. 11 is a diagram illustrating a radiation pattern of the antenna structure 100 shown in FIG. 1, wherein FIG. 10 shows measurement results of the conventional monopole antenna in the YZ plane and FIG. 11 shows measurement results of the antenna structure 100 in the YZ plane. As can be seen, the radiation pattern of the antenna structure 100 has a wider half power beam-width.

Figure 12:
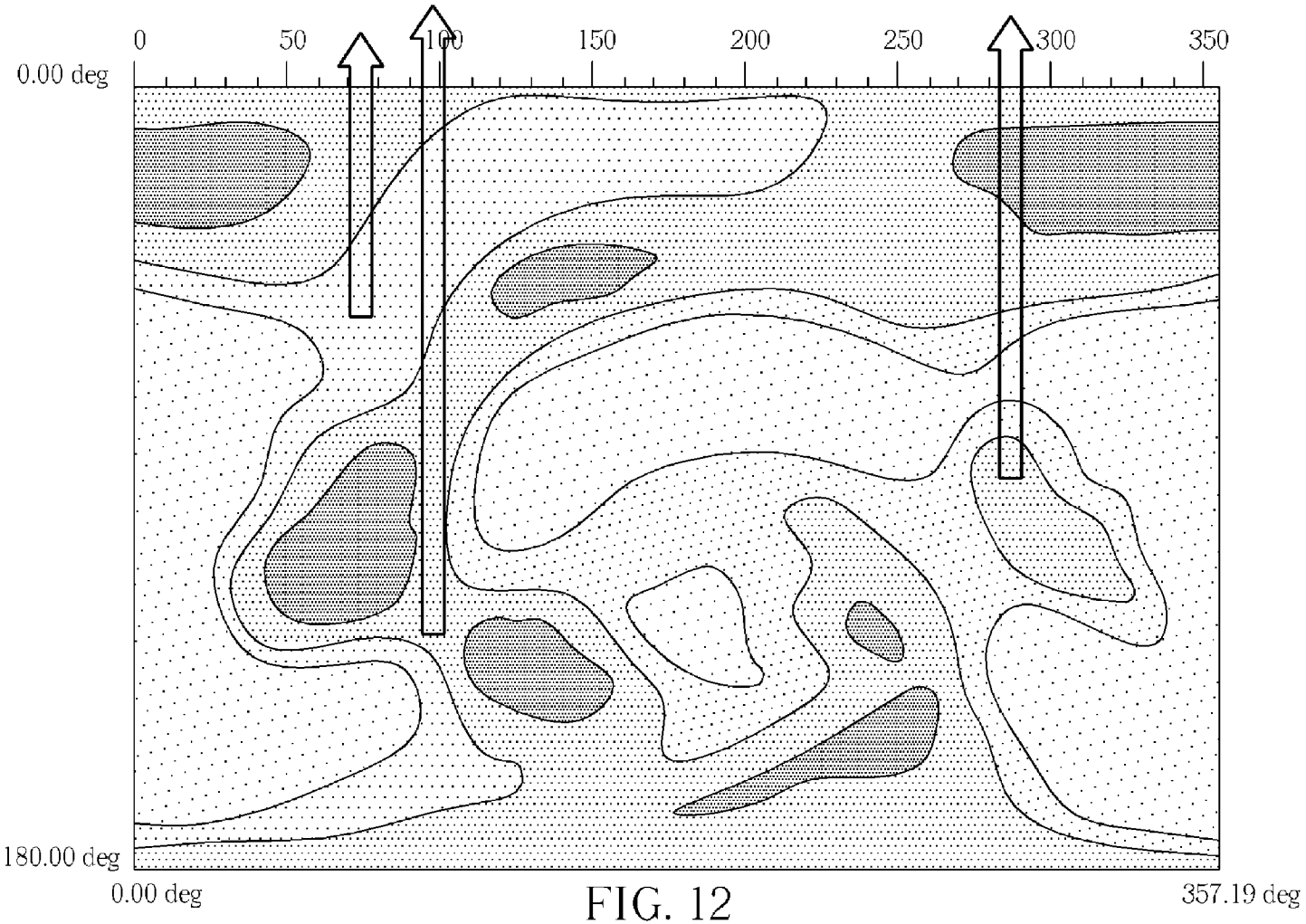
FIG. 12 is a diagram illustrating the energy distribution of the conventional monopole antenna.
Figure 13:
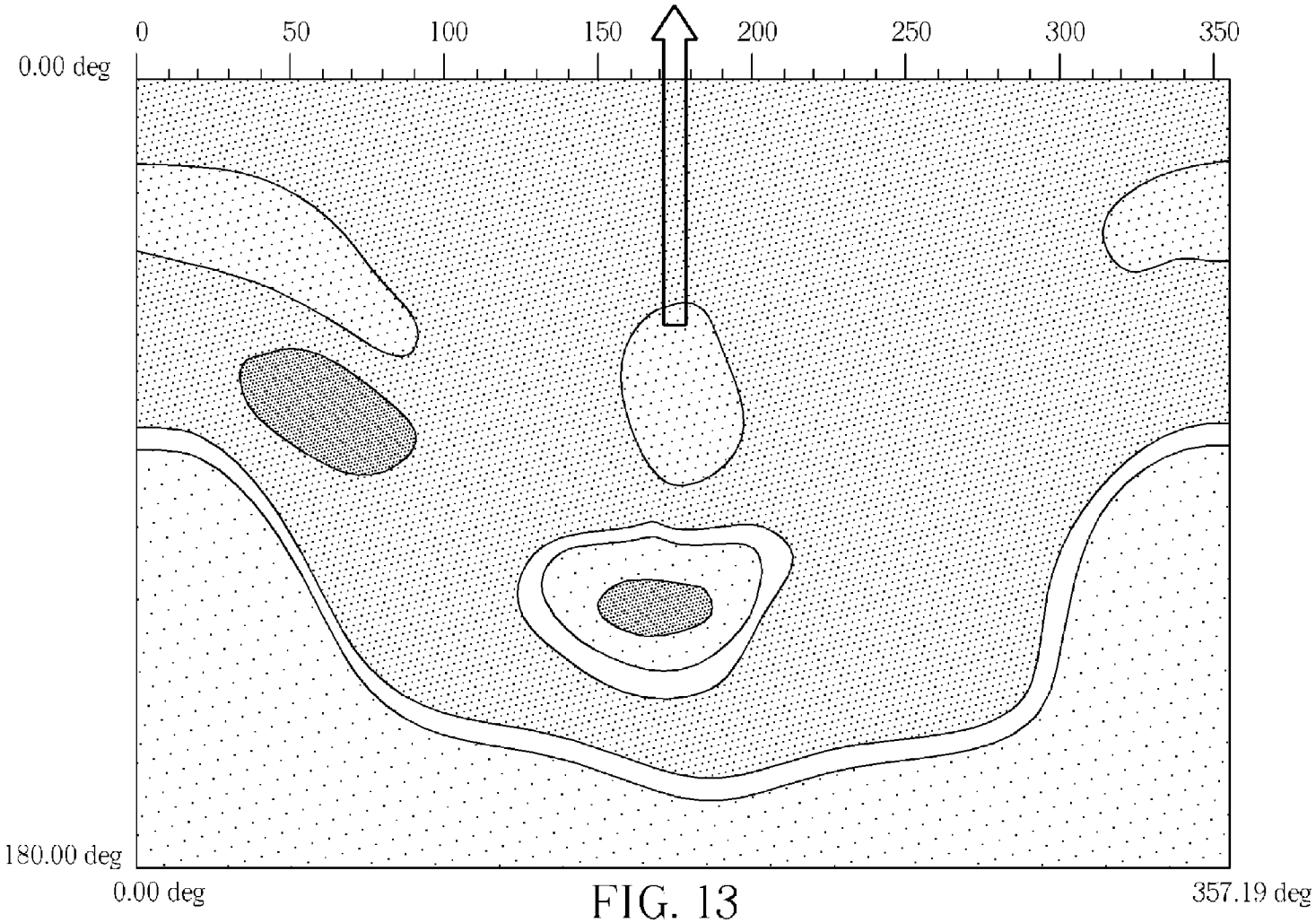
FIG. 13 is a diagram illustrating the energy distribution of the antenna structure shown in FIG. 1.

Please refer to FIG. 12 together with FIG. 13. FIG. 12 is a diagram illustrating the energy distribution of the conventional monopole antenna, and FIG. 13 is a diagram illustrating the energy distribution of the antenna structure 100 shown in FIG. 1. The energy strength is represented by the distribution density of dots, wherein the energy strength gets stronger as the distribution density of dots is denser. As can be known by comparing them, the energy distribution of the conventional monopole antenna is much looser, and the energy distribution of the antenna structure 100 centers upwards (i.e., the +Z axis in FIG. 1).

Figure 14:
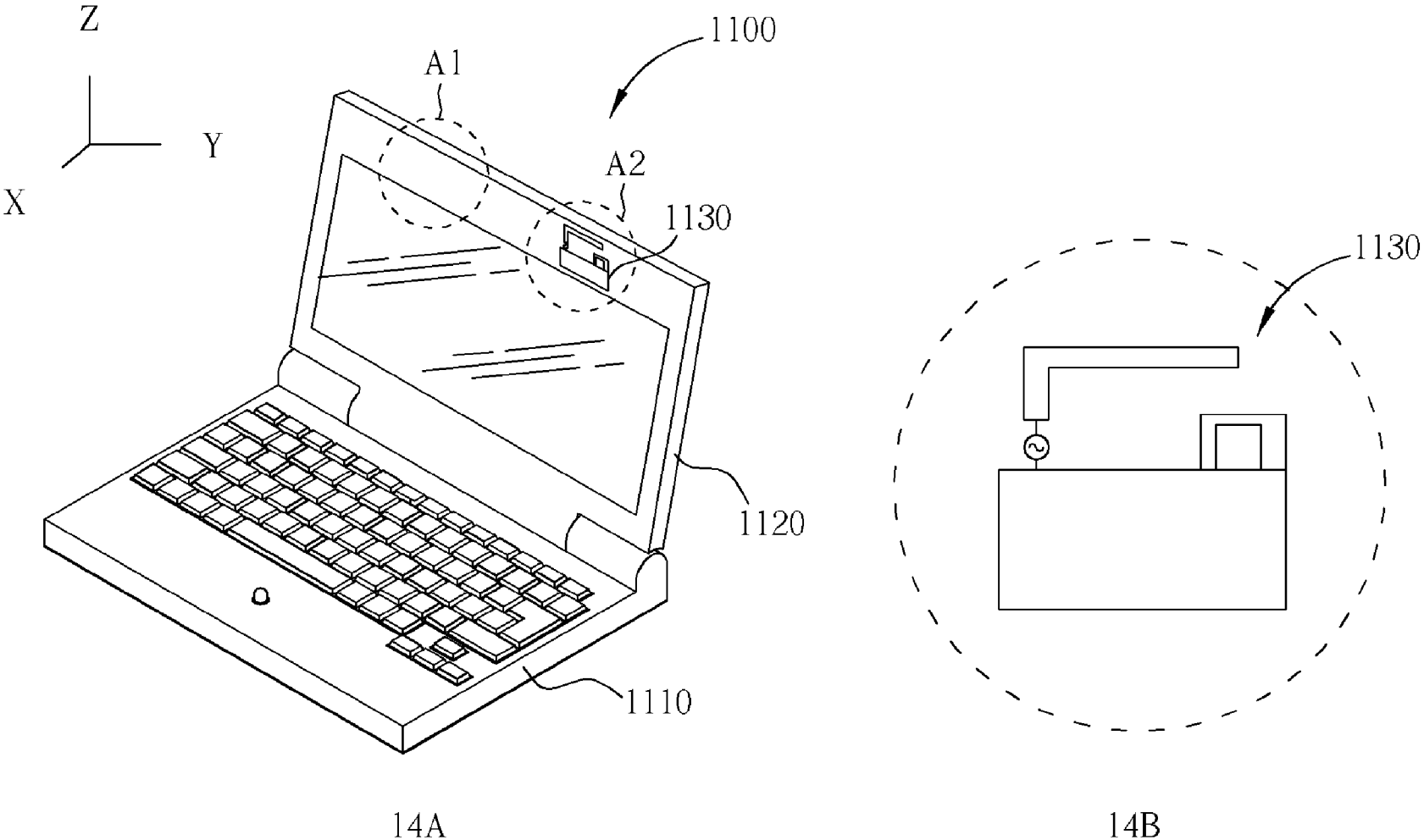
FIG. 14 is a diagram of a wireless communication apparatus according to an embodiment of the present invention.

Please refer to FIG. 14. FIG. 14 is a diagram of a wireless communication apparatus 1100 according to an embodiment of the present invention. In this embodiment, the wireless communication apparatus 1100 is a notebook computer, but is not a limitation of the present invention and can be a wireless communication apparatus of another type. As shown in 14A, the wireless communication apparatus 1100 includes a housing 1110 and an antenna 1130, wherein the antenna 1130 is disposed inside the housing 1110 and is parallel to a first plane 1120 of the housing 1110. When a user starts using the wireless communication apparatus 1100, the first plane 1120 of the housing 1110 is located at a Y-Z plane and the antenna 1130 is disposed at locations A1 or A2 of the first plane 1120. As shown in 14B, the antenna 1130 can be implemented by the antenna structure 100 shown in FIG. 1. Of course, the antenna 1130 can also be implemented by changed forms of the antenna structure 100, such as the antenna structures 200-700 in FIG. 2-FIG. 7 or any combinations of them.

Please note that when the user starts using the wireless communication apparatus 1100, the first plane 1120 of the housing 1110 and the antenna 1130 are located on the Y-Z plane. As can be seen from the antenna structure 100 in FIG. 1, the impedance matching and radiation patterns of the antenna structure can be changed by a capacitor effect generated from the overlapped portion 160 of the section 142 and the radiation element 110 to center the radiation patterns and the energy of the antenna 1130 onto the +Z axis.

From the above descriptions, the present invention provides the antenna structures 100-700 and related wireless communication apparatus 1100. Through additionally disposing the sections 141, 142, and 143 of the second grounding sub-element 140, the direction of the current $I_2$ can be adjusted. In addition, the overlapped portion 160 of the section 142 and the radiation element 110 can adjust the impedance matching and radiation patterns of the antenna structure. As can be known from FIG. 1 and FIG. 14, when the user starts using the wireless communication apparatus 1100, the first plane 1120 of the housing 1110 is located on the Y-Z plane and the antenna structure 1130, implemented by the antenna structure 100, is also located on the Y-Z plane. At this time, the impedance matching and radiation patterns of the antenna structure can be changed by the capacitor effect generated from the overlapped portion 160 to center the radiation patterns and the energy of the antenna 1130 onto the +Z axis. Compared with the conventional monopole antenna, the radiation patterns of the antenna structures disclosed in the present invention can be centered upwards and have better half power beam-width. Hence, the antenna structures disclosed in the present invention are suitably applied to wireless communication systems like GPS.

Those skilled in the art will readily observe that numerous modifications and alterations of the device and method may be made while retaining the teachings of the invention.

What is claimed is:

1. An antenna structure, comprising:

a radiation element;

a grounding element, comprising:

a first grounding sub-element; and a second grounding sub-element, coupled to the first grounding sub-element, having a loop structure, wherein one section of the loop structure overlaps a first end of the radiation element and is at a designated distance from the first end of the radiation element in a designated direction; and a feeding point, coupled between a second end of the radiation element and the first grounding sub-element.

2. The antenna structure of claim 1, wherein the second grounding sub-element is located on a Y-Z plane, and a projection of the radiation element projected on an X-Y plane partially overlaps a projection of the second grounding sub-element projected on the X-Y plane.

3. The antenna structure of claim 1, wherein the second grounding sub-element comprises a plurality of sections coupled to each other to construct the loop structure, and a joint point of a first section and a second section of the plurality of sections forms a right angle.

4. The antenna structure of claim 1, wherein the second grounding sub-element comprises a plurality of sections coupled to each other to construct the loop structure, and a joint point of a first section and a second section of the plurality of sections forms an oblique angle.

5. The antenna structure of claim 1, wherein the second grounding sub-element comprises a plurality of sections coupled to each other to construct the loop structure, and a joint point of a first section and a second section of the plurality of sections forms an arc angle.

6. The antenna structure of claim 1, wherein the loop structure comprises a plurality of loops.

7. The antenna structure of claim 1, further comprising an active component disposed between the second end of the radiation element and the feeding point.

8. The antenna structure of claim 7, wherein the active component is a low-noise amplifier (LNA).

9. The antenna structure of claim 1, wherein the radiation element forms an L shape.

10. An antenna structure, comprising:

a radiation element;

a grounding element, comprising:

a first grounding sub-element; and a second grounding sub-element, coupled to the first grounding sub-element, having a plurality of sections coupled to each other, wherein a designated section of the plurality of sections overlaps the radiation element and is at a first designated distance from the radiation element in a designated direction, and the designated section is at a second designated distance from the first grounding sub-element in a direction opposite to the designated direction; and a feeding point, coupled between a second end of the radiation element and the first grounding sub-element.

11. The antenna structure of claim 10, wherein there is a first current flowing through the radiation element and a second current flowing through the designated section, and a direction of the first current is opposite to a direction of the second current.

12. The antenna structure of claim 11, wherein the designated section is parallel to the radiation element and the first grounding sub-element.

13. A wireless communication apparatus, comprising:

a housing; and an antenna structure, disposed inside the housing and parallel to a first plane of the housing, the antenna structure comprising:

a radiation element;

a grounding element, comprising:

a first grounding sub-element; and a second grounding sub-element, coupled to the first grounding sub-element, having a loop structure, wherein one section of the loop structure overlaps a first end of the radiation element and is at a designated distance from the first end of the radiation element in a designated direction; and a feeding point, coupled between a second end of the radiation element and the first grounding sub-element.

14. The wireless communication apparatus of claim 13, wherein the second grounding sub-element of the antenna structure and the first plane of the housing are located on a Y-Z plane, and a projection of the radiation element projected on an X-Y plane partially overlaps a projection of the second grounding sub-element projected on the X-Y plane.

15. The wireless communication apparatus of claim 13, wherein the second grounding sub-element comprises a plurality of sections coupled to each other to construct the loop structure, and a joint point of a first section and a second section of the plurality of sections forms a right angle.

16. The wireless communication apparatus of claim 13, wherein the second grounding sub-element comprises a plurality of sections coupled to each other to construct the loop structure, and a joint point of a first section and a second section of the plurality of sections forms an oblique angle.

17. The wireless communication apparatus of claim 13, wherein the second grounding sub-element comprises a plurality of sections coupled to each other to construct the loop structure, and a joint point of a first section and a second section of the plurality of sections forms an arc angle.

18. The wireless communication apparatus of claim 13, wherein the loop structure comprises a plurality of loops.

19. The wireless communication apparatus of claim 13, wherein the antenna structure further comprises an active component disposed between the second end of the radiation element and the feeding point.

20. The wireless communication apparatus of claim 19, wherein the active component is a low-noise amplifier (LNA).

* * * * *